United States Patent [19]

Beierlein et al.

[11] Patent Number: 5,042,057

[45] Date of Patent: Aug. 20, 1991

[54] X-RAY DIAGNOSTICS INSTALLATION

[75] Inventors: Rainer Beierlein, Spardorf; Gerhard Kuetterer, Erlangen, both of Fed. Rep. of Germany

[73] Assignee: Siemens Aktiengesellschaft, Munich, Fed. Rep. of Germany

[21] Appl. No.: 522,159

[22] Filed: May 10, 1990

[30] Foreign Application Priority Data

May 10, 1989 [EP] European Pat. Off. ..... 89108405.5

[51] Int. Cl.[5] ..... H05G 1/64

[52] U.S. Cl. ..... 378/99; 358/111

[58] Field of Search ..... 378/99; 358/111

[56] References Cited

U.S. PATENT DOCUMENTS 3,244,878 4/1966 Stein et al. .
4,058,833 11/1977 Meyer .
4,272,782 6/1981 Proper et al. ..... 358/111
4,359,759 11/1982 McBride et al. ..... 358/111
4,736,399 4/1988 Okazaki .
4,749,257 6/1988 Klausz .

FOREIGN PATENT DOCUMENTS

0046609A1 7/1981 European Pat. Off. .

*Primary Examiner*—Craig E. Church
*Attorney, Agent, or Firm*—Hill, Van Santen, Steadman & Simpson

[57] ABSTRACT

An x-ray diagnostics installation having a transmission chain subject to imaging errors. The transmission chain has at least an x-ray image intensifier and an optical system for imaging the output image of the x-ray image intensifier onto a video pick-up coupled to the optical system. The optical system has a distortion which compensates for the imaging errors of the other elements of the transmission chain such that the imaging errors of the transmission chain are substantially eliminated.

14 Claims, 1 Drawing Sheet

X-RAY DIAGNOSTICS INSTALLATION

BACKGROUND OF THE INVENTION

The present invention is directed to an x-ray diagnostics installation having a transmission chain which is subject to imaging errors. The transmission chain has an x-ray image intensifier and an optical means for imaging the output image of the x-ray image intensifier onto a video pick-up means coupled to the optical means. Such apparatus serve, for example, for video reproduction of x-ray pictures.

German reference DE-A-31 27 648 discloses such an x-ray diagnostics installation wherein the output image of the x-ray image intensifier is imaged onto a coupled image pick-up means by a basic objective coupled to the x-ray image intensifier and by a camera objective. In this case, the image is produced on a target area of a video camera.

It is not only the x-ray image intensifier but also the video chain that produce pillow-shaped distortions. A non-uniform brightness distribution ("vignetting"), that drops off concentrically from the middle of the image to the edge of the image, results in the image from these distortions as well as from the distance of the camera objective from the basic objective.

In order to obtain a more uniform brightness distribution, the video signal was previously differently amplified, whereby the signal at the image edge was more amplified than that in the middle of the image. However a lower signal-to-noise ratio results at the edge of the image, so that the noise is disturbingly increased. Moreover, this method of producing a more uniform brightness distribution is only effective in a video camera. It is not effective in other image pick-up devices such as, for example, a motion picture camera or a medium format camera.

SUMMARY OF THE INVENTION

The present invention is based on the object of creating an x-ray diagnostics installation of the type initially cited with which a simple, effective and disturbance-free correction of imaging errors (distortion, vignetting) is achieved.

This object is inventively achieved in that the optical means has a distortion which compensates for the imaging errors of other elements in the transmission chain such that the imaging errors of the transmission chain are eliminated. As a result the imaging errors of the x-ray image intensifier, particularly the distortion and differing brightness distribution in the image, are corrected by the optics. Optical distortion corrections can be achieved by providing spherical or aspherical curvatures of individual elements of the optical means, by varying the spacing of the elements of the optical means or by the glass selected for the optics.

In an x-ray diagnostics installation having a tandem optics as an optical means that has a basic objective and a camera objective, both as well as only one of these objectives can be advantageously provided with barrel-shaped distortions for correction. Correction measures can also be implemented in view of glass selection and shape when screen carrier and/or an end pane of the x-ray image intensifier and/or a stray light trap effect a correction of the distortion.

An adaptation to different input fields of a switchable x-ray intensifier can be achieved when different distortion corrections can be set. This can be effected by setting elements for varying the optical property of the optical means when these setting elements are connected to individual elements of the optical means. A variable distortion correction can also be achieved when a plurality of optical elements are located on a turret arrangement, these optical elements being optionally pivotable into the beam path of the optical means.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures in which like reference numerals identify like elements, and in which:

DESCRIPTION OF THE PREFERRED EMBODIMENT

Figure 1:
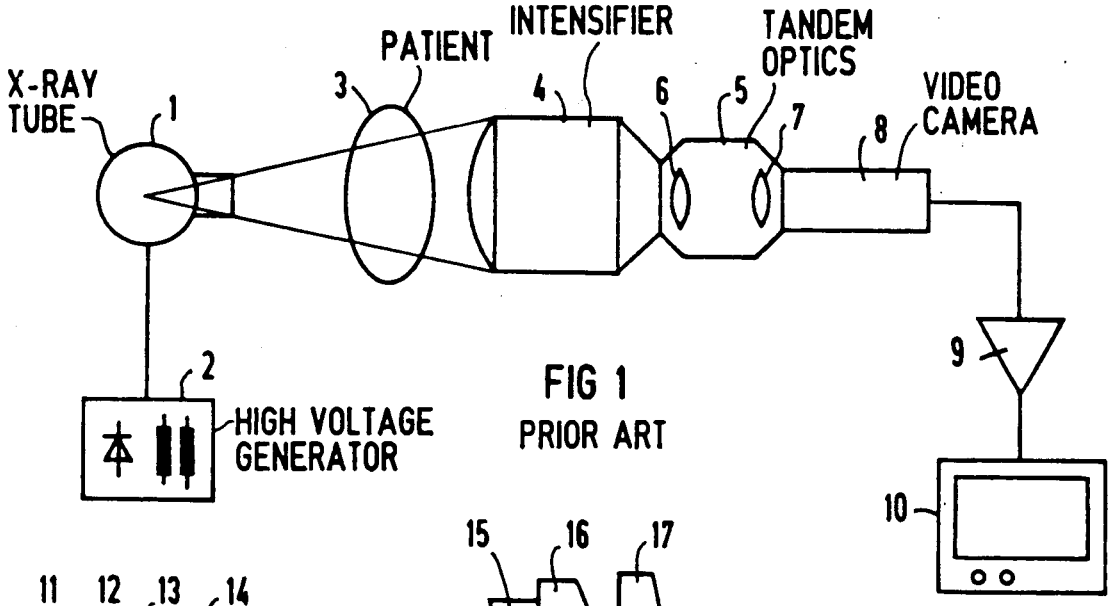
FIG 1 PRIOR ART
FIG. 1 depicts an x-ray diagnostics installation of the prior art.

FIG. 1 shows an x-ray tube 1 that is operated by a high-voltage generator 2 and emits an x-ray beam that penetrates a patient 3 and casts a radiation image onto an input luminescent screen of the x-ray image intensifier 4. The x-ray image intensifier 4 converts the radiation image into a visible image on an output luminescent screen. A tandem optics 5 that contains a basic objective 6 and a camera objective 7 is coupled to the x-ray image intensifier 4. The output image of the x-ray image intensifier 4 is imaged on the target of a video camera 8 through these objectives 6 and 7. The output signal of the video camera 8 is amplified in a video amplifier 9 and is reproduced as a visible image on a monitor 10.

Figure 3:
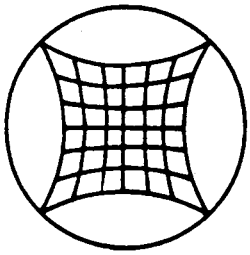
FIG. 3 depicts a greatly exaggerated example of an imaging error at the output luminescent screen of the x-ray image intensifier.
Figure 5:
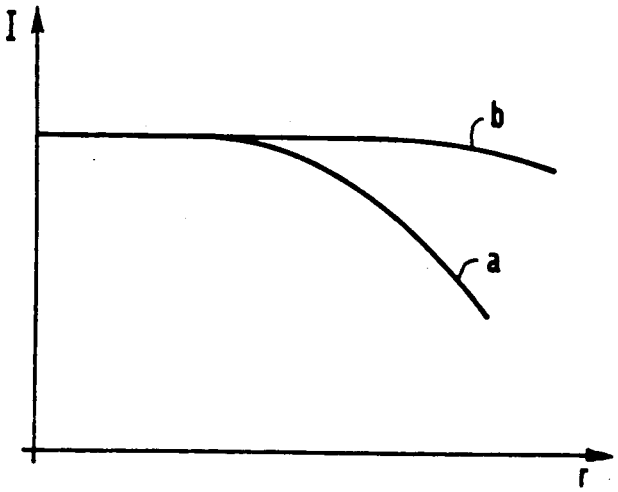
FIG. 5 is a graph showing brightness curves at a spacing from the image center without and with correction.

Such transmission equipment 4–10 have many imaging errors. Included among these are pillow-shaped distortion errors that, for example, produce an imaging distorted pillow-shaped pattern shown exaggerated in FIG. 3, which is produced from a rectangular grid pattern. At the same time, the image has a brightness drop toward edges of the pattern. This is shown by way of example in FIG. 5 with reference to curve a. In this illustration, the intensity I of the brightness is a function of the distance r from the image center.

Figure 2:
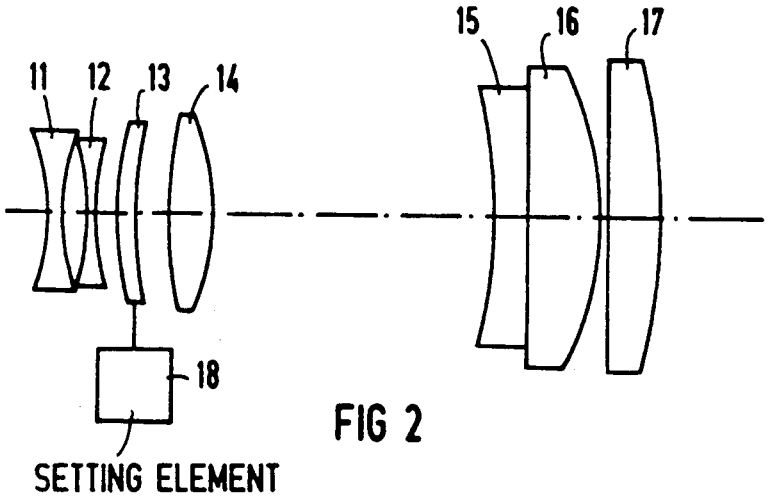
FIG. 2 depicts the elements of an objective of the x-ray diagnostics installation according to the present invention and used in the installation of FIG. 1.

The objectives 6 and 7 can have the structure shown in FIG. 2. In this example, they are composed of seven elements 11–17 that are partly arranged in groups. The correction of the distortion thereby occurs as a partial correction or a full correction by designing the elements 11–17 that together have an optical, barrel-shaped distortion. As a result the pillow-shaped distortion of, in particular, the x-ray image intensifier 4 and also of the transmission chain 8–10 is corrected.

Figure 4:
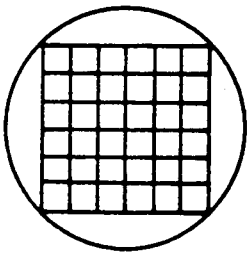
FIG. 4 depicts the x-ray image corrected by the distortion correction and incident on an image pick-up transducer.

For full distortion correction, the image has the desired, straight-line pattern of the lines shown in FIG. 4. As a consequence of the complete elimination or at least of the diminishing of the distortion-induced brightness drop, the brightness distribution in the image has much improved characteristic shown in FIG. 5 with reference to curve b.

A partial correction, that has less of a pillow-shaped distortion than previously, can be provided for the largest x-ray image intensifier format that can be set. The smallest x-ray image intensifier format can be over-corrected by a medium, barrel-shaped distortion. Such a correction would be of interest, for example, for medium-format through large-format image intensifiers 4 for extremity angiography.

The barrel-shaped distortion correction can also be designed such that a defined input field of a switchable x-ray image intensifier 4, that, for example, is preferably used for measurements (cardiac volume, vessel diameter), is optimally corrected, whereas the large and/or smaller input fields are under-corrected or over-corrected, respectively.

The correction measures can occur both within only one objective 6 or 7 of the tandem optics 5 or can also be divided into both objectives 6 and 7 of the tandem optics 5. The optically effective components of the x-ray image intensifier 4 such as, for example, the screen carrier, the end pane, and the stray light trap can also be involved in the consideration of the distortion correction, so that the structural length of the x-ray image intensifier 4 can be shortened and/or additional degrees of freedom for calculating the electron optics are obtained.

Given the employment of switchable x-ray image intensifiers 4, it would be expedient if the distortion correction were also variable. As shown in FIG. 2, this can occur, for example, with setting elements 18 within the objective 6 and/or 7. These setting elements 18 vary the spacings of the individual elements 11–17 relative to one another. However, instead of the setting elements 18 that effect a displacement of, for example, the optical element 13, what is referred to as a turret arrangement can also be used, wherein different elements 13, for example, are attached thereto and are capable of being pivoted into the beam path depending on the format of the x-ray image intensifier 4.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. X-ray diagnostics installation having a transmission chain subjected to imaging errors, said transmission chain having at least an x-ray image intensifier and an optical means for imaging the output image of the x-ray image intensifier on a means for image pick-up coupled to said optical means, comprising said optical means having distortion which compensates for the imaging errors of other elements of the transmission chain such that the imaging errors of the transmission chain are substantially eliminated.

2. The X-ray diagnostics installation according to claim 1, wherein said optical means is a tandem optics that has at least a basic objective and a camera objective, and wherein both objectives of the tandem optics are provided with distortions for correction of the imaging errors.

3. The X-ray diagnostics installation according to claim 1, wherein said optical means is a tandem optics that has a basic objective and a camera objective, and wherein only one of the objectives of the tandem optics is provided with distortion for correction of the imaging errors.

4. The X-ray diagnostics installation according to claim 1, wherein at least one of a screen carrier, an end pane of the x-ray image intensifier, and a stray light trap effect a correction of the imaging errors.

5. The X-ray diagnostics installation according to claim 1, wherein different distortion corrections can be set for at least one element in the transmission chain.

6. The X-ray diagnostics installation according to claim 5, wherein setting elements for varying the optical property of the optical means are connected to individual elements of the optical means.

7. The X-ray diagnostics installation according to claim 5, wherein a plurality of optical elements that are optionally pivotal into a beam path of the optical means are arranged on a turret arrangement.

8. X-ray diagnostics installation having a transmission chain subjected to imaging errors, said transmission chain having at least an x-ray image intensifier and an optical means for imaging the output image of the x-ray image intensifier on a means for image pick-up coupled to said optical means, comprising said optical means having distortion which compensates for the imaging errors of other elements of the transmission chain such that the imaging errors of the transmission chain are substantially eliminated, wherein at least one of screen carrier, an end pane of the x-ray image intensifier, and a stray light trap of the optical means effect a correction of the imaging errors.

9. The X-ray diagnostics installation according to claim 8, wherein different distortion corrections can be set for at least one element in the transmission chain.

10. The X-ray diagnostics installation according to claim 8, wherein setting elements for varying the optical property of the optical means are connected to individual elements of the optical means.

11. The X-ray diagnostics installation according to claim 8, wherein a plurality of optical elements that are optionally pivotal into a beam path of the optical means are arranged on a turret arrangement.

12. X-ray diagnostics installation having a transmission chain subjected to imaging errors, said transmission chain having at least an x-ray image intensifier and an optical means for imaging the output image of the x-ray image intensifier on a means for image pick-up coupled to said optical means, comprising said optical means having distortion which compensates for the imaging errors of other elements of the transmission chain such that the imaging errors of the transmission chain are substantially eliminated, said optical means being a tandem optics that has at least a basic objective and a camera objective, at least one of the basic objective and the camera objective of the tandem optics being provided with the distortions for correction of the imaging errors.

13. The X-ray diagnostics installation according to claim 12, wherein setting elements for varying the optical property of the optical means are connected to individual elements of the optical means.

14. The X-ray diagnostics installation according to claim 12, wherein a plurality of optical elements that are optionally pivotal into a beam path of the optical means are arranged on a turret arrangement.

* * * * *